US007721777B2

(12) United States Patent
Costello

(10) Patent No.: US 7,721,777 B2
(45) Date of Patent: May 25, 2010

(54) MODIFIABLE AND CUSTOMIZABLE ARTICLE CARRIER BUILT OF ZIPPER STRIPS

(75) Inventor: Christopher Costello, Richmond, VA (US)

(73) Assignee: Bubbafus, LLC, Richmond, VA (US)

( * ) Notice: Subject to any disclaimer, the term of this patent is extended or adjusted under 35 U.S.C. 154(b) by 1171 days.

(21) Appl. No.: 11/329,462

(22) Filed: Jan. 11, 2006

(65) Prior Publication Data

US 2007/0158006 A1 Jul. 12, 2007

(51) Int. Cl.

| | |
|---|---|
| ***A45C 13/10*** | (2006.01) |
| ***A45C 13/26*** | (2006.01) |
| ***A45C 13/30*** | (2006.01) |
| ***A45C 1/02*** | (2006.01) |
| ***A45C 3/06*** | (2006.01) |

(52) U.S. Cl. ..... 150/103; 150/107; 150/128; 190/103; 190/903; 383/2; 383/4; 383/97

(58) Field of Classification Search ..... 150/127, 150/128, 103, 107, 110; 190/103, 117, 903, 190/1, 105; 383/4, 97, 2
See application file for complete search history.

(56) References Cited

U.S. PATENT DOCUMENTS

| | | | | | |
|---|---|---|---|---|---|
| 2,030,360 | A * | 2/1936 | Dyer | 190/117 |
| 2,127,067 | A * | 8/1938 | Moss | 150/104 |
| 2,536,169 | A * | 1/1951 | Gray | 190/103 |
| 4,081,061 | A * | 3/1978 | Tucker | 190/108 |
| 4,415,012 | A * | 11/1983 | Bose | 383/37 |
| 4,436,189 | A * | 3/1984 | Baum | 190/108 |
| D278,388 | S * | 4/1985 | Ueda | D3/301 |
| D279,143 | S * | 6/1985 | Ueda | D3/301 |
| 4,598,802 | A * | 7/1986 | Abenaim | 190/107 |
| 4,634,031 | A | 1/1987 | Frankhouse | |
| 4,781,278 | A * | 11/1988 | Sadow | 190/107 |
| D326,560 | S * | 6/1992 | Schanzer | D3/301 |
| 5,186,290 | A * | 2/1993 | Takayama | 190/108 |
| 5,509,515 | A * | 4/1996 | Guo | 190/110 |
| 6,138,881 | A * | 10/2000 | Paul et al. | 224/153 |
| 6,647,555 | B2 * | 11/2003 | Yamaguchi et al. | 2/338 |
| D504,565 | S * | 5/2005 | Heatherwick | D3/233 |
| D505,259 | S * | 5/2005 | Heatherwick | D3/233 |
| 2004/0221392 | A1 * | 11/2004 | Tsai | 5/626 |
| 2007/0044878 | A1 * | 3/2007 | Metsch | 150/127 |

OTHER PUBLICATIONS www.bambags.com/zippursebags.html.

* cited by examiner

*Primary Examiner*—Sue A Weaver
(74) *Attorney, Agent, or Firm*—Thomas, Karceski, Raring & Teague, P.C.

(57) ABSTRACT

The invention relates to an article carrier and, more specifically, to a customizable and modifiable article carrier built from a plurality of zipper strips. Each strip includes two bands of flexible material adjoined along an adjacent edge. The opposing edges of the bands have a toothed edge operable to lock to a toothed edge on an adjoining strip via a zipping mechanism. A plurality of strips are combined to form an article carrier compartment with optional closures and carrying straps.

15 Claims, 5 Drawing Sheets

MODIFIABLE AND CUSTOMIZABLE ARTICLE CARRIER BUILT OF ZIPPER STRIPS

The present invention relates to an article carrier built of zipper strips and, more specifically, to a selectively modifiable article carrier such as purses and the like.

BACKGROUND

The state of design is constantly in flux. From household appliances to architecture and apparel, design is constantly changing. Consumers have developed more particular and demanding tastes with each generation as they seek products that are comfortable, unique, and practical all in one package. Often, these characteristics are non-complimentary in that a unique product may not be practical. Consumers also want modern products to conform to the specific tasks at hand. They value the ability to modify and personalize their products in order to fit the situation or their personalities. Clearly, modern designers have a difficult task of predicting design and social change.

Article carriers, such as luggage, purses, briefcases, carryalls and the like, is one specific area that undergoes nearly continuous design change. Consumers will move from hard to soft-sided article carriers. Colors are also cyclical, varying between vibrant and loud to soft and dull. Even the size and shape of the article carriers varies. Small clutch purses may be demanded by consumers one month only to be replaced by large duffel-type purses the next month.

Despite the demand for nearly continuous change and consumers' desire to modify and customize article carriers, current article carriers offer very limited choices for customization or modification. Most commonly, the consumer can merely pick from a range of colors and materials. Customization and modification after the purchase is usually discouraged, impractical, or impossible.

As such, there is a clear need within the article carrier industry for an inexpensive, easy to operate, simple, durable, and selectively modifiable article carrier. The article carrier of the present invention addresses at least one of the shortcomings in the prior art.

SUMMARY OF THE INVENTION

In accordance with the present invention, an article carrier built of zipper strips is provided. More specifically, the article carrier of the present invention is selectively modifiable and customizable. The article carrier is formed from a plurality of individual zipper strips. Each strip will comprise two bands of flexible material joined along an adjacent edge. The outer, or opposing edges, will have integral zipper teeth. Unlike a traditional purse, jacket, or pants zipper that closes a single article of clothing or article carrier, the toothed edges are located on the exterior edges of the zipper strip. Therefore, the toothed edges can only be locked with another zipper strip by combining two strips.

Building an article carrier from a plurality of zipper strips is a unique construction technique with distinct advantages over the prior art. For instance, zipper strips can be inserted into or removed from the article carrier in order to modify the size of the article carrier. Inserting and removing strips also allows a user to customize or modify the colors and style of the article carrier. Strips can be exchanged between different styles or types of bags in order to create completely modified, personalized, and distinct article carriers.

An article carrier in accordance with the present invention efficiently address at least one of the shortcomings associated with prior art article carriers. The foregoing and additional features and advantages of the present invention will become apparent to those of skill in the art from the following detailed description of a preferred embodiment taken in conjunction with the accompanying drawings.

DETAILED DESCRIPTION

An article carrier in accordance with the present invention provides the article carrier industry with an inexpensive, easy to operate, simple, durable, and selectively modifiable article carrier. The article carrier allows a consumer to selectively modify and customize their article carrier. The article carrier is formed from a plurality of zipper strips. It should be noted that a large variety of styles and types of article carriers are envisioned besides the illustrated embodiments. Zipper strips can be added or removed from the article carrier. In fact, zipper strips from two or more different types or styles of bags can be swapped between the different types and styles of article carriers. Therefore, it will be obvious to one of skill in the art that the size, shape, and type of article carrier might vary from what is specifically described and illustrated without leaving the scope of the invention.

Figure 1:
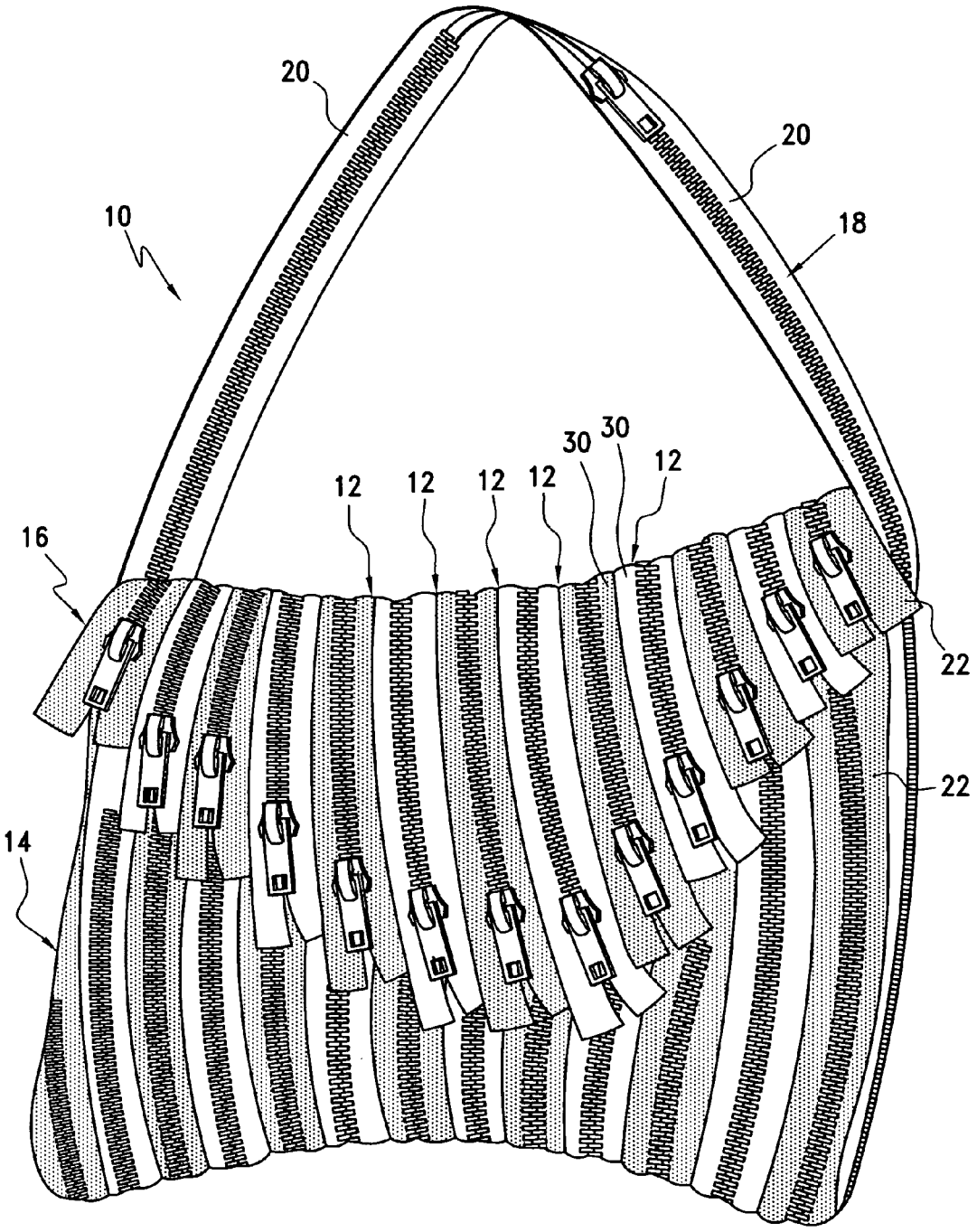
FIG. 1 is a perspective view of an article carrier in accordance with one embodiment of the present invention.

Turning to FIG. 1, an article carrier 10 that is comprised of a plurality of zipper strips 12 is illustrated. Zipper strips 12 in conjunction with an end zippers 20 define a compartment or receptacle portion 14 covered by an optional flap 16, as explained further below. End zippers 20 may extend beyond the compartment 14 to form an optional strap 18.

End zippers 20 include a first end, a second end, and two lateral sides with a traditional zipper running the length of the end zipper. To form a strap 18, the first end of each end zipper 20 would abut the first end of a corresponding end zipper 20. The abutting first ends are joined to each other by sewing the ends, fusing the ends, or otherwise joining the ends by means that would be obvious to one of skill in the art. The joined end zippers form a convenient means to transport carrier 10. Because the first ends are secured together, unzipping the end zipper does not disconnect or separate the carrier whereas unzipping a zipper strip 12 would divide the article carrier. Again, depending on the style and type of article carrier, strap 18 is entirely optional. It is also envisioned that strap 18 might be formed from a number of suitable materials, such as a standard fabric, leather, suede or the like.

With or without strap 18, carrier 10 includes end zippers 20. An end border 22 is sewn along a first lateral side of the end zipper wherein border 22 wraps around the second end of each end zipper 20 and is then sewn along the second lateral edge of the end zipper 20. The second ends of end zippers 20 are sewn to the border 20. Therefore, unzipping end zippers 20 does not lead to the end zippers 20 separating from the article carrier.

As illustrated in FIG. 1, border 22 extends "higher" along one side of end zipper 20 than border 22 does on the second side of the strap zipper. An end portion of the border's "longer" side is not sewn to the end zipper. Therefore, the longer portion of border 22 can be folded over the "shorter" portion. This creates a flap.

The outer edge of border 22 includes a toothed edge that allows border 22 to be selectively connected corresponding toothed edges provided by zipper strips 12 (as explained further below) or even, potentially, to a toothed edge on a corresponding border on a second end zipper. Other construction techniques are available.

Figure 3:
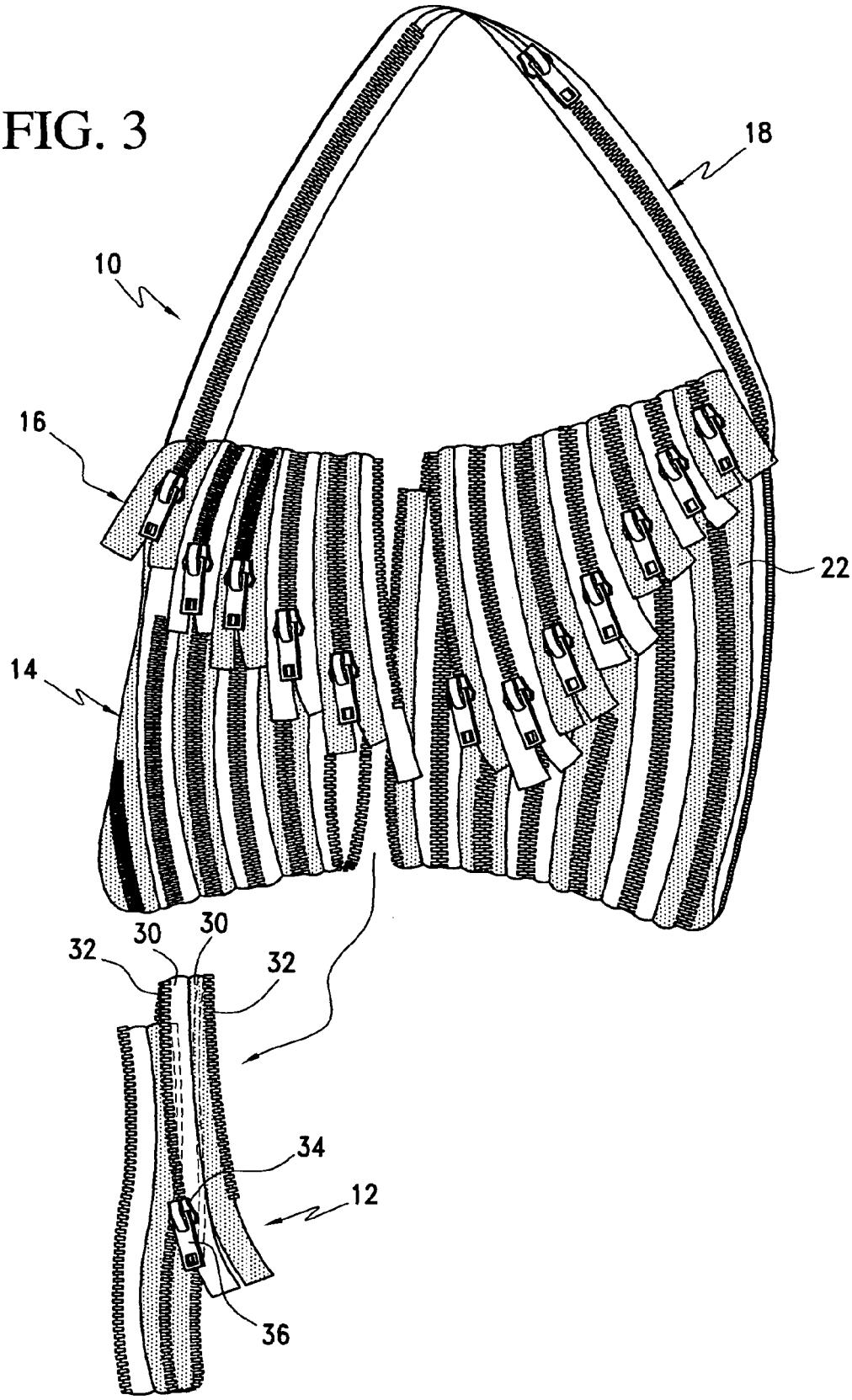
FIG. 3 is a perspective view of an article carrier in accordance with one embodiment of the present invention wherein an unzipped zipper strip has been removed from the article carrier.
Figure 4:
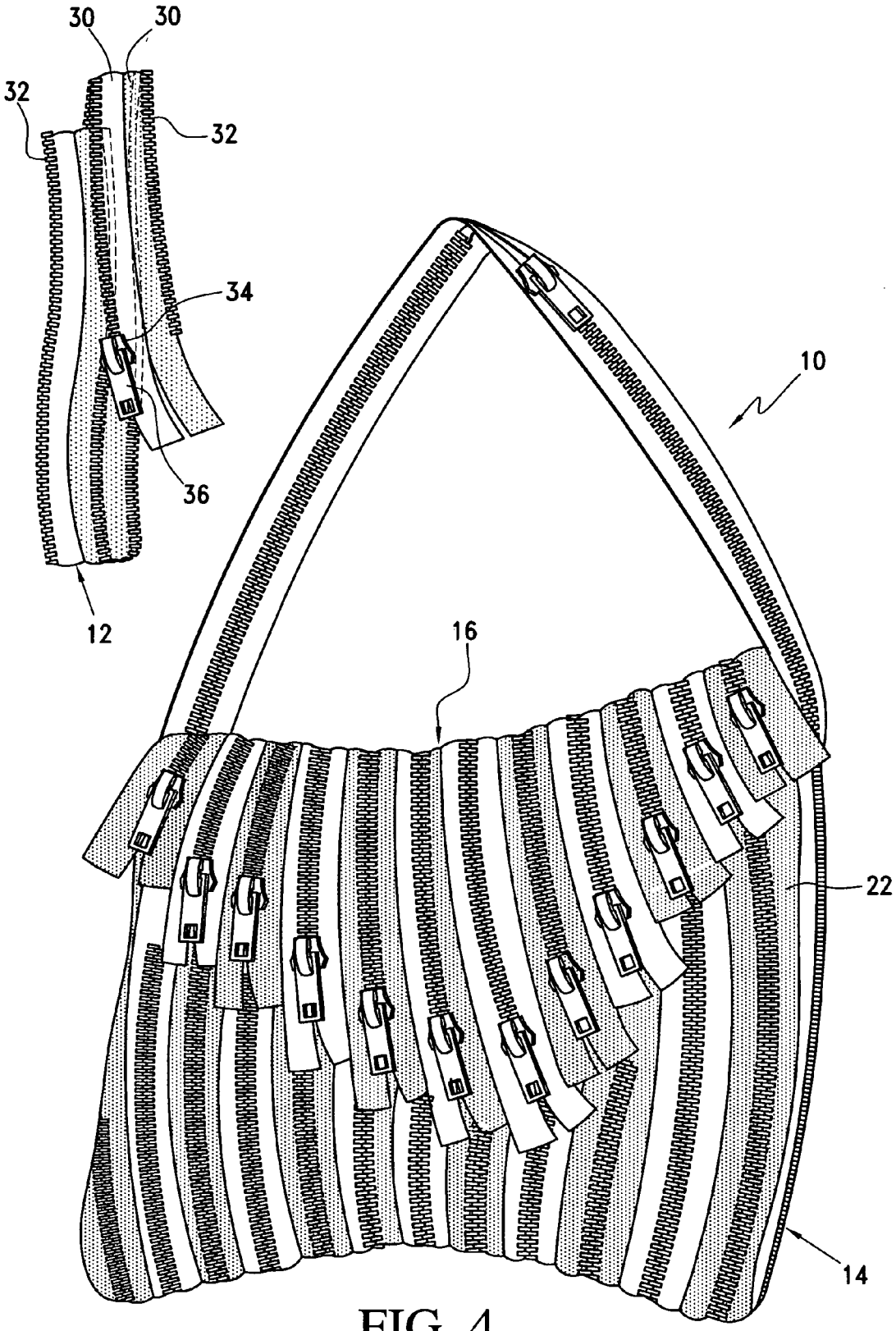
FIG. 4 is a perspective view of the article carrier of FIG. 3 wherein the article carrier is reformed after the removal of a zipper strip.

As may be more clearly illustrated in FIGS. 3 and 4, each zipper strip 12 consists of two elongated fabric bands 30. Bands 30 are of the same length and width, although variations in size are envisioned. In particular styles or types of article carriers, one of the two joined bands might be either longer, wider, longer and wider, or shaped differently than the other joined band. For instance, to create the V-shaped flap as illustrated in FIG. 1, where the center of the flap is longer than the flap near the sides of the article carrier, bands 30 on each strip 12 could be slightly staggered in length to create the tapered look. Half the zipper strips would be staggered so the left band is shorter than the right band while the other half would have a shorter right band than the left band.

The tapered look can also be achieved by sewing the same size bands together in a slightly skewed fashion. Using this technique, the tapered look can be created by varying the way a given zipper strip is sewn together.

Bands 30 are placed side-by-side so that each band has an adjacent lateral edge and an opposing lateral edge. The adjacent edges on the two bands 30 are permanently joined by conventional means, such as sewing, adhesives, heat bonding or the like. The fabric material can be any known flexible purse or article carrier material, including, but not limited to, cotton, polyester, suede, leather, linen, and the like.

A toothed edge 32 is provided on the opposing side of each joined band 30. The toothed edge locks with the toothed edge of an adjacent zipper strip 12 via a known zipping mechanism including a common slider 34 with a pull tab 36. A plurality of zipper strips 12 are then zipped together. These combined zipper strips can be inserted between the borders 22.

In order to create a flap, zipper strips 12 are of sufficient length to be folded twice. The first fold creates the article carrier compartment. This is the fold dictated by joining a zipper strip to border 22 that folds around the second end of the end zipper 20. The second fold provides a loose end of the strip that overlies the first folded section. This loose end acts as flap 16. This is facilitated by a border 22 that has one loose end, as explained above. The border, however, does not necessarily need to include a flap. The individual strips in FIGS. 3 and 4 illustrate this specific construction.

Figure 2:
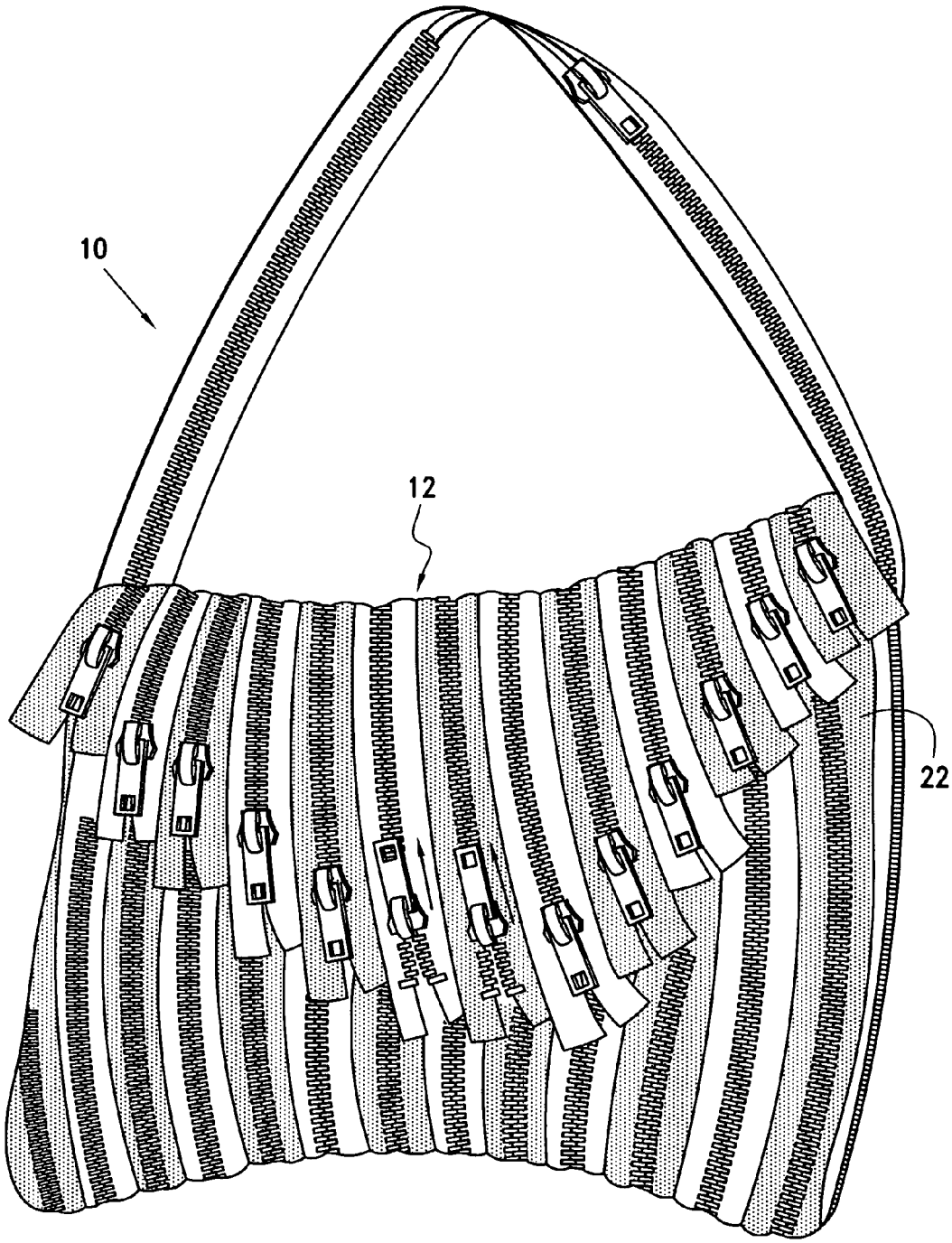
FIG. 2 is a perspective view of an article carrier in accordance with one embodiment of the present invention wherein a zipper strip is in the process of being unzipped.

Article carrier 10 of the present invention is constructed from a plurality of zipper strips. This construction is also the mechanism that allows a consumer to customize and modify their article carrier. In FIG. 2, there is illustrated the initial process step of a process whereby a zipper strip 12 is removed from article carrier 10 to alter both the look and size of the carrier. Strip 12 includes opposing sides with toothed edges. By unzipping the edges from the adjacent strips via slides 34 and pull tabs 36, the strip can be removed. The zipping motion occurs in the direction of the two arrows. It would also be possible to unzip only one edge in order to insert a new strip, thereby altering the look of carrier 10 while expanding the size of the compartment.

FIG. 3 illustrates the strip that is unzipped in FIG. 2 in a spaced relationship to carrier 10. FIG. 4, in turn, illustrates carrier 10 wherein the carrier is reformed following the removal of the strip. Compartment 14 has been reduced in size. The appearance has also been modified and/or customized. Obviously, the new dimensions create a new "look". However, as bands 30 will often be colored, sometimes in alternating or complimentary colors, removing or adding a strip will change the appearance of carrier 10. In this manner, a consumer can create a distinctive look or accent a color found in their apparel. Zipper strips 12 can be exchanged between different carriers for very personalized, distinctive and/or eclectic styles.

Figure 5:
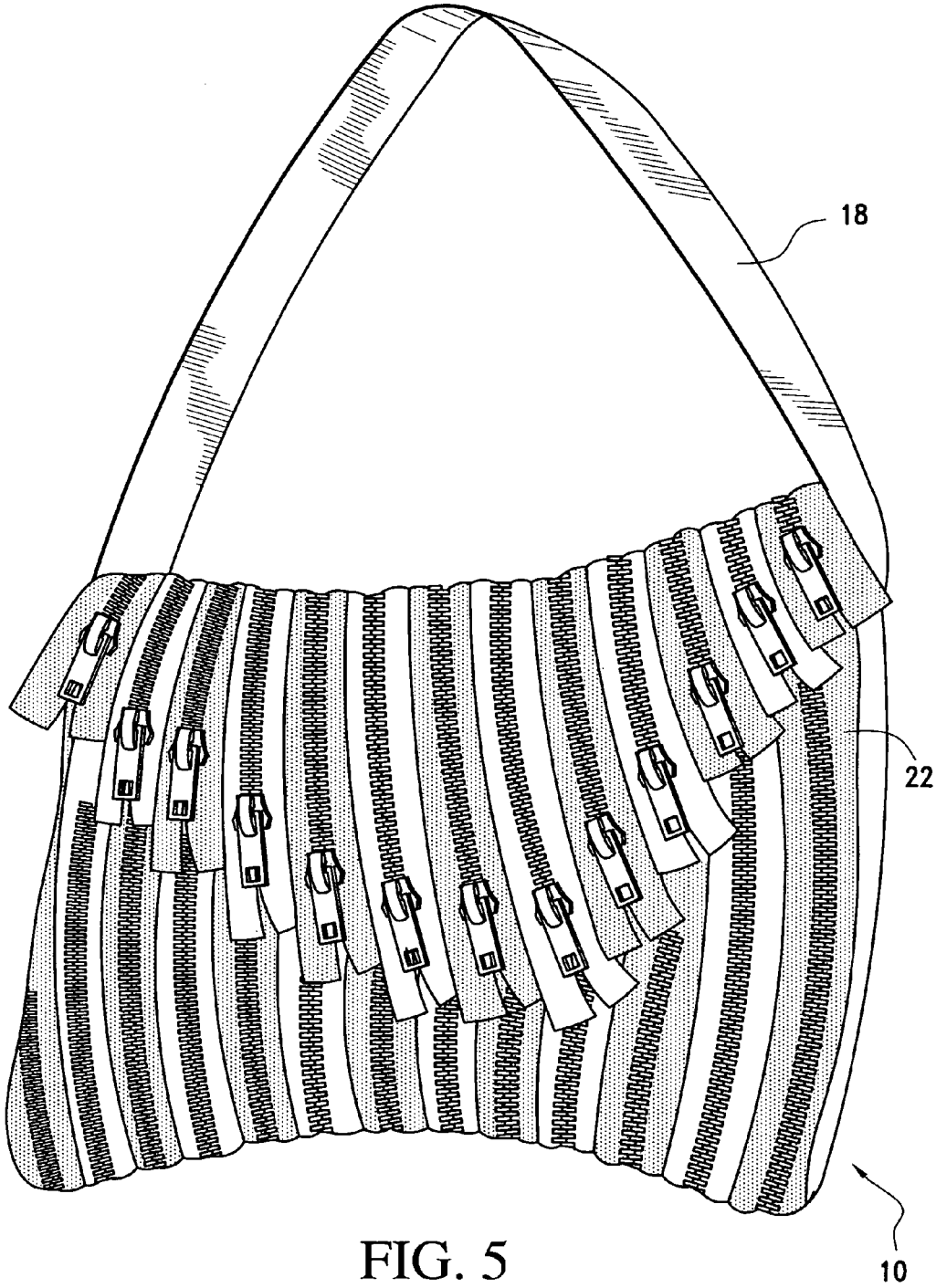
FIG. 5 is another perspective view of an article carrier wherein an article carrier strap that is not a zipper is illustrated in accordance with one embodiment of the present invention.

It should be noted that the end zippers or the optional strap do not need to include zippers. In FIG. 5 an embodiment of carrier 10 is illustrated whereby a strap is provided without zippers. This allows the strap to be one piece of fabric with two ends that are joined by border 22. Border 22 is still sewn around the second end of the strap. The strap is, of course, optional. However, end zippers 20 could also be replaced by a solid piece of fabric even if strap 18 is eliminated.

One skilled in the art will appreciate that the specific style or type of carrier is not limited to the above description or the figures. Carrier 10 could be a pouch, carry all, backpack, or other type of article carrier. Therefore, while the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A modifiable and customizable article carrier comprising:

a plurality of zipper strips, each zipper strip including two elongated bands of flexible material, each band having an adjoining edge and an opposing edge, the adjoining edge being permanently joined to a corresponding band, the opposing edge having a toothed edge;

each strip having a first toothed edge and a second toothed edge;

a zipper slide provided on the first toothed edge, the zipper slide operable to selectively lock the first toothed edge to the second toothed edge of a corresponding zipper strip, the first toothed edge and the second toothed edge of the corresponding zipper strip comprising a separating zipper when unlocked, the plurality of zipper strips forming an article carrier;

the article carrier comprising a compartment and a flap operable to selectively close the compartment and the flap formed via a portion of the plurality of zipper strips overlying a second portion of the plurality of zipper strips; and the individual zipper strips being selectively removed and inserted from the plurality of zipper strips forming the article carrier.

2. The carrier of claim 1, further comprising a strap operable to transport the article carrier.

3. The carrier of claim 2, wherein the strap further comprises a pair of end zippers substantially the entire length of the strap.

4. The carrier of claim 1, wherein at least one additional zipper strip is added to the carrier in order to increase the size of the article carrier formed by the plurality of zipper strips.

5. The carrier of claim 1, wherein at least one zipper strip is removed from the carrier in order to decrease the size of the article carrier formed by the plurality of zipper strips.

6. The carrier of claim 1, further comprising a first end strip and a second end strip, each end strip having a first end, a second end, and two opposing outer edges, the opposing outer edges connected to the article carrier.

7. The carrier of claim 6, wherein the first end strip and the second end strip include a first border and a second border joined to a corresponding end strip at the opposing outer edges of each end strip and at one end of each end strip;

wherein each border includes a toothed, unjoined edge to be joined to a corresponding toothed edge provided by the article carrier.

8. The carrier of claim 7, wherein the toothed edge of the first border is joined to the toothed edge of the second border.

9. The carrier of claim 8, wherein the toothed edge of the first border is connected to the toothed edge of the second border via at least one zipper strip.

10. A modifiable and customizable article carrier comprising:

a plurality of zipper strips, each zipper strip having a first toothed edge and a second toothed edge and at least two elongated bands permanently joined together between the opposing toothed edges, where the zipper strips do not comprise snap fasteners;

a zipper slide provided on the first toothed edge, the zipper slide operable to selectively lock the first toothed edge to the second toothed edge of a corresponding zipper strip, the first toothed edge and the second toothed edge of the corresponding zipper strip comprising a separating zipper when unlocked, the plurality of zipper strips forming an article carrier; and the individual zipper strips being selectively removed and inserted from the plurality of zipper strips forming the article carrier.

11. The carrier of claim 10, the carrier further comprising a compartment and a flap operable to selectively close the compartment.

12. A method for modifying an article carrier comprising:

providing an article carrier comprised of a plurality of zipper strips, each zipper strip having two opposing toothed edges and at least two elongated and flexible bands permanently joined together between the opposing toothed edges, the opposing toothed edges joined to corresponding toothed edges;

unzipping a zipper strip via a zipper slide along both toothed edges, the step of unzipping both toothed edges further comprising the step of separating the zipper strip from any adjoining zipper strip;

removing the unzipped zipper strip from the article carrier; and rezipping the corresponding toothed edges together in order to reform the article carrier.

13. The method of claim 12, further comprising the steps of connecting the plurality of zipper strips to a first end strip and a second end strip, each end strip having a first end, a second end, and two opposing outer edges, wherein the opposing outer edges and one end of each end strip include zipper teeth to be connected to the corresponding toothed edge provided by the article carrier.

14. The method of claim 13, wherein the teeth of the first end strip is joined to the teeth of the second end strip.

15. The method of claim 14, wherein the teeth of the first end and second end are connected via at least one intervening zipper strip.

* * * * *